US011832075B2

(12) United States Patent
Lv et al.

(10) Patent No.: US 11,832,075 B2
(45) Date of Patent: Nov. 28, 2023

(54) DOUBLE-SIDED VIBRATING SPEAKER

(71) Applicant: FORTUNE GRAND TECHNOLOGY INC., Taoyuan (TW)

(72) Inventors: Jian Lv, Taoyuan (TW); Ming-Jun Zeng, Taoyuan (TW); Yi-Yong Li, Taoyuan (TW); Zan-Hua Liu, Taoyuan (TW)

(73) Assignee: FORTUNE GRAND TECHNOLOGY INC., Taoyuan (TW)

( * ) Notice: Subject to any disclaimer, the term of this patent is extended or adjusted under 35 U.S.C. 154(b) by 58 days.

(21) Appl. No.: 17/701,719

(22) Filed: Mar. 23, 2022

(65) Prior Publication Data

US 2022/0322013 A1 Oct. 6, 2022

(30) Foreign Application Priority Data

Mar. 30, 2021 (CN) ..... 202110343455.3

(51) Int. Cl.

| | |
|---|---|
| ***H04R 9/06*** | (2006.01) |
| ***H04R 1/28*** | (2006.01) |
| ***H04R 7/12*** | (2006.01) |
| ***H04R 9/02*** | (2006.01) |
| ***H04R 9/04*** | (2006.01) |

(52) U.S. Cl.

CPC ..... *H04R 9/063* (2013.01); *H04R 1/2826* (2013.01); *H04R 1/2896* (2013.01); *H04R 7/12* (2013.01); *H04R 9/025* (2013.01); *H04R 9/046* (2013.01); *H04R 2400/11* (2013.01)

(58) Field of Classification Search

CPC . H04R 9/00; H04R 9/02; H04R 9/025; H04R 9/063; H04R 9/046; H04R 9/06; H04R 7/22; H04R 7/16; H04R 7/20; H04R 7/12; H04R 31/006; H04R 1/2826; H04R 1/2896; H04R 2400/11

USPC ..... 381/398, 396, 41, 405, 412, 420, 409

See application file for complete search history.

(56) References Cited

U.S. PATENT DOCUMENTS

| | | | | |
|---|---|---|---|---|
| 10,631,096 | B1 * | 4/2020 | Garcia Selva | H04R 9/06 |
| 2008/0317255 | A1 * | 12/2008 | Cozens | H04R 9/10 381/182 |
| 2020/0045426 | A1 * | 2/2020 | Song | H04R 1/06 |
| 2022/0150641 | A1 * | 5/2022 | Ko | H04R 1/02 |

FOREIGN PATENT DOCUMENTS

| | | | | |
|---|---|---|---|---|
| CN | 109195078 A | * | 1/2019 | H04R 9/025 |
| CN | 109511061 A | * | 3/2019 | H04R 9/06 |
| CN | 112511959 A | * | 3/2021 | H04R 9/06 |
| CN | 214014517 U | * | 8/2021 | H04R 9/02 |

* cited by examiner

*Primary Examiner* — Ahmad F. Matar
*Assistant Examiner* — Sabrina Diaz

(57) ABSTRACT

A double-sided vibrating speaker includes a magnet member, a first vibration member and a second vibration member. The magnet member has a main magnetic unit, a first magnetic unit and a second magnetic unit, the main magnetic unit has a main magnetic plate and two side magnetic plates, the main magnetic plate has air vents, each the side magnetic plate is provided on two sides of the main magnetic plate, the main magnetic unit forms an H-shape. The first vibration member is disposed on one surface of the magnet member, the second vibration member is disposed on another surface of the magnet member.

14 Claims, 8 Drawing Sheets

A-A

B-B

B-B

DOUBLE-SIDED VIBRATING SPEAKER

CROSS-REFERENCE TO RELATED APPLICATION

This non-provisional application claims priority under 35 U.S.C. § 119(a) on Patent Application No(s). 202110343455.3 filed in China on Mar. 30, 2021, the entire contents of which are hereby incorporated by reference.

BACKGROUND OF THE INVENTION

1. Field of the Invention

The present disclosure relates to a double-sided vibrating speaker, and in particular to a double-sided vibrating speaker, which can sound in two ways.

2. Description of the Related Art

In general, a speaker must be installed in a cabinet to improve low-frequency performance.

However, when the low frequency or voltage of the speaker increases, the diaphragm will produce a large amplitude of oscillation, so it is easy to cause the entire speaker to vibrate with it. Because the speaker must be installed in the cabinet, the vibration of the speaker will be further transmitted to the cabinet, causing the cabinet to resonate with the speaker, resulting in noise and distortion.

Thus, it is desirable to develop a double-sided vibrating speaker, which is expected to achieve the effect of two-way sounding in the case of constant size, and achieve the purpose of increasing the output volume and bass, increase the vibration control and avoid noise and distortion that are to be actively disclosed by the disclosure.

BRIEF SUMMARY OF THE INVENTION

In view of the shortcomings of the above-mentioned prior art, the inventor felt that it was not perfect, and exhausted his mind to research carefully into a way for overcoming the problems, and then developed a double-sided vibrating speaker, with a view to achieving the effect of two-way sounding in the case of constant size, and achieving the purpose of increasing the output volume and bass, increasing the vibration control and avoiding noise and distortion.

To achieve the above objective and other objectives, the present disclosure provides a double-sided vibrating speaker, comprising: a magnet member, a first vibration member and a second vibration member. The magnet member comprises a main magnetic unit, a first magnetic unit and a second magnetic unit, the main magnetic unit has a main magnetic plate and two side magnetic plates, the main magnetic plate has at least one air vent, each the side magnetic plate is provided on two sides of the main magnetic plate, the main magnetic plate respectively has at least one assembly part at two sides, each the side magnetic plate has at least one docking part in combination with the assembly part, the main magnetic unit forms an H-shape, the first magnetic unit is disposed on one surface of the main magnetic plate, the second magnetic unit is disposed on another surface of the main magnetic plate, the first magnetic unit has a first magnetic gap, the second magnetic unit has a second magnetic gap; the first vibration member comprises a first speaker frame, a first voice coil and a first diaphragm, the first speaker frame is configured with a surface of the magnet member, the first voice coil is movably configured in the first magnetic gap and configured with the first diaphragm, the first diaphragm is configured with the first speaker frame; the second vibration member comprises a second speaker frame, a second voice coil and a second diaphragm, the second speaker frame is configured with another surface of the magnet member, the second voice coil is movably configured in the second magnetic gap and configured with the second diaphragm, the second diaphragm is configured with the second speaker frame, the second speaker frame and the first speaker frame are combined with each other.

In the above-mentioned double-sided vibrating speaker, the main magnetic plate respectively has the assembly part at two sides of two end parts, each the side magnetic plate has the two docking parts in combination with each the assembly part.

In the above-mentioned double-sided vibrating speaker, each the assembly part respectively has a stop part at two sides, and each the assembly part exceeds the stop parts in position, each the stop part stops each the side magnetic plate, each the assembly part fails to exceed each the docking part in position.

In the above-mentioned double-sided vibrating speaker, the docking part is a penetration hole.

In the above-mentioned double-sided vibrating speaker, the first speaker frame and the second speaker frame respectively have at least one open pore on two sides, each the open pore communicates the air vent.

In the above-mentioned double-sided vibrating speaker, the main magnetic plate respectively has the air vents on two sides, each the air vent is recessed, each the side magnetic plate has a breathable hole in communication with each the air vent, the first speaker frame and the second speaker frame respectively have at least one open pore on two sides, each the open pore communicates each the breathable hole.

In the above-mentioned double-sided vibrating speaker, the first speaker frame respectively have at least one first opening part on two sides, the second speaker frame respectively have at least one second opening part on two sides, each the first opening part and each the second opening part correspond to each other to form the open pore.

In the above-mentioned double-sided vibrating speaker, the first vibration member further comprises two first dampers, each the first damper has a first fixed part at one side, each the first damper combines with the first voice coil at another side, the first speaker frame respectively has a first combination part at two sides, the first fixed part of each the first damper is combined to each the first combination part of the first speaker frame, each the first combination part is located at the open pore; the second vibration member further comprises two second dampers, each the second damper has a second fixed part at one side, each the second damper combines with the second voice coil at another side, the second speaker frame respectively has a second combination part at two sides, the second fixed part of each the second damper is combined to each the second combination part of the second speaker frame, each the second combination part is located at the open pore.

In the above-mentioned double-sided vibrating speaker, each the side magnetic plate has a breathable hole, a hole diameter of each the breathable hole is greater than a thickness of the main magnetic plate, each the breathable hole is provided across one surface and another surface of the main magnetic plate, the first speaker frame and the second speaker frame respectively have at least one open pore on two sides, each the open pore communicates each the breathable hole and the air vent.

In the above-mentioned double-sided vibrating speaker, the main magnetic plate respectively has the air vents on two sides, each the air vent is recessed, the first speaker frame and the second speaker frame respectively have at least one open pore on two sides, each the open pore communicates each the air vent.

In the above-mentioned double-sided vibrating speaker, each the side magnetic plate respectively has a connecting part at two ends, the first speaker frame and the second speaker frame are correspondingly assembled to the connecting parts, a space area is formed between the outer side of each the side magnetic plate and the first speaker frame and the second speaker frame.

In the above-mentioned double-sided vibrating speaker, corresponding assembly places of the first speaker frame and the connecting parts are respectively provided with a protruding part, the connecting part of each the side magnetic plate and each the protruding part are abutted against each other, so that the space area is formed between the outer side of each the side magnetic plate and the first speaker frame and the second speaker frame.

In the above-mentioned double-sided vibrating speaker, the first magnetic unit has a first magnet and a first magnetic plate, the second magnetic unit has a second magnet and a second magnetic plate, the first magnet is disposed on one surface of the main magnetic plate, the first magnetic plate is disposed on the first magnet, the second magnet is disposed on another surface of the main magnetic plate, the second magnetic plate is disposed on the second magnet.

In the above-mentioned double-sided vibrating speaker, the first vibration member further comprises two first dampers, each the first damper has a first fixed part at one side, each the first damper combines with the first voice coil at another side, the first speaker frame respectively has a first combination part at two sides, the first fixed part of each the first damper is combined to each the first combination part of the first speaker frame; the second vibration member further comprises two second dampers, each the second damper has a second fixed part at one side, each the second damper combines with the second voice coil at another side, the second speaker frame respectively has a second combination part at two sides, the second fixed part of each the second damper is combined to each the second combination part of the second speaker frame.

Accordingly, the double-sided vibrating speaker of the present disclosure may have a two-way sounding effect in the case of constant size, thereby enhancing the output volume and bass, and the first vibration member and the second vibration member may be actuated at the same time, so the vibration control is increased and the force between each other is offset, in order to avoid resonance to produce noise and distortion.

DETAILED DESCRIPTION OF THE INVENTION

To facilitate understanding of the object, characteristics and effects of this present disclosure, embodiments together with the attached drawings for the detailed description of the present disclosure are provided.

Figure 1:
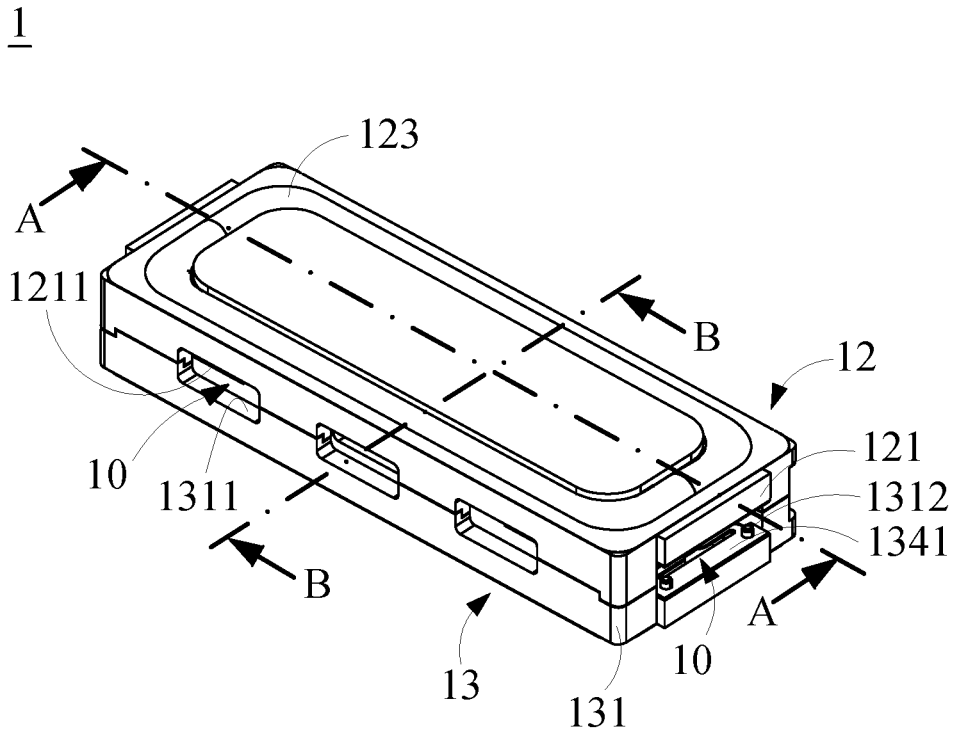
FIG. 1 is a schematic outside view of a double-sided vibrating speaker of the present disclosure.
Figure 2:
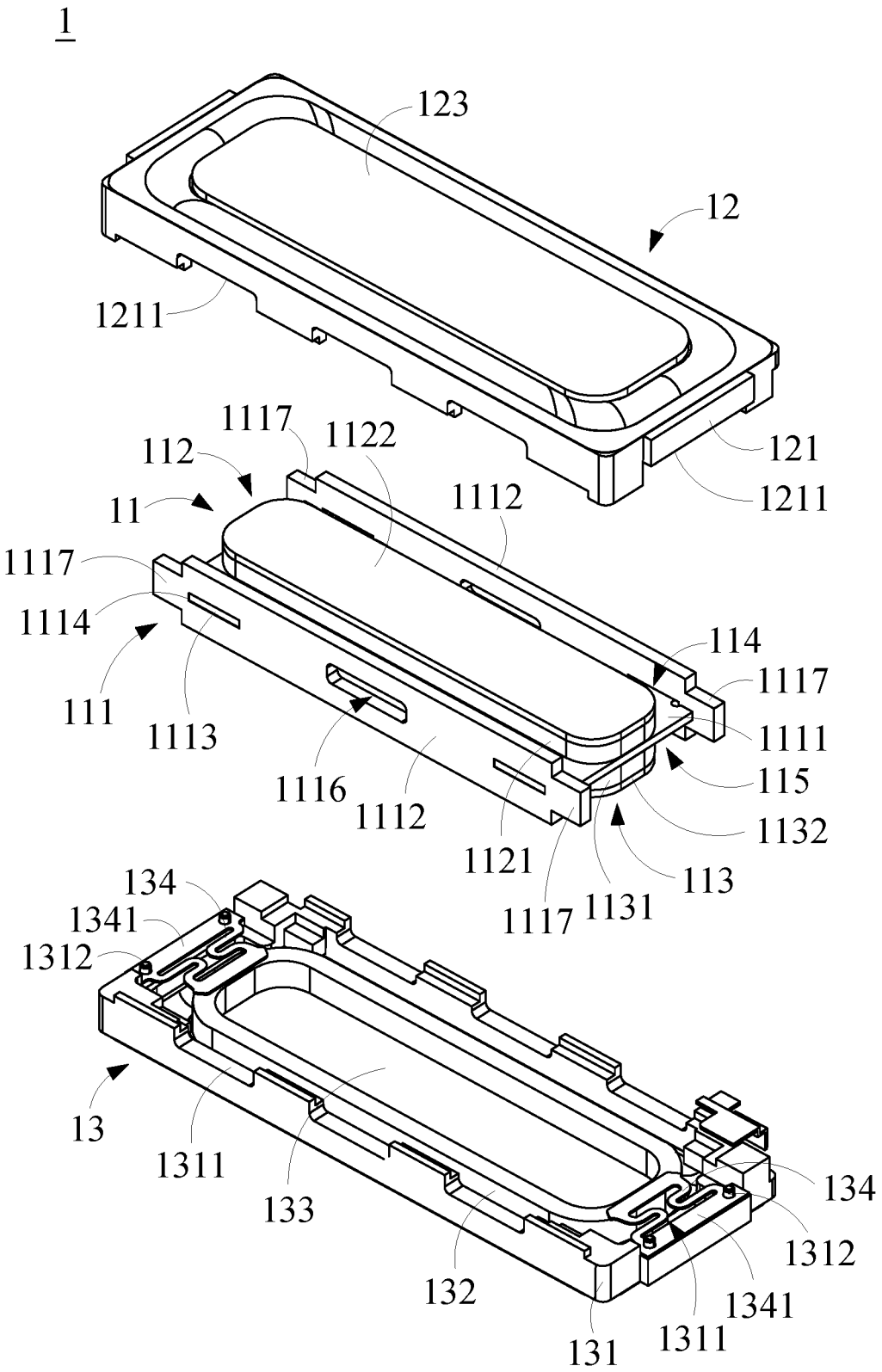
FIG. 2 is a schematic exploded view of the double-sided vibrating speaker of the present disclosure.
Figure 3:
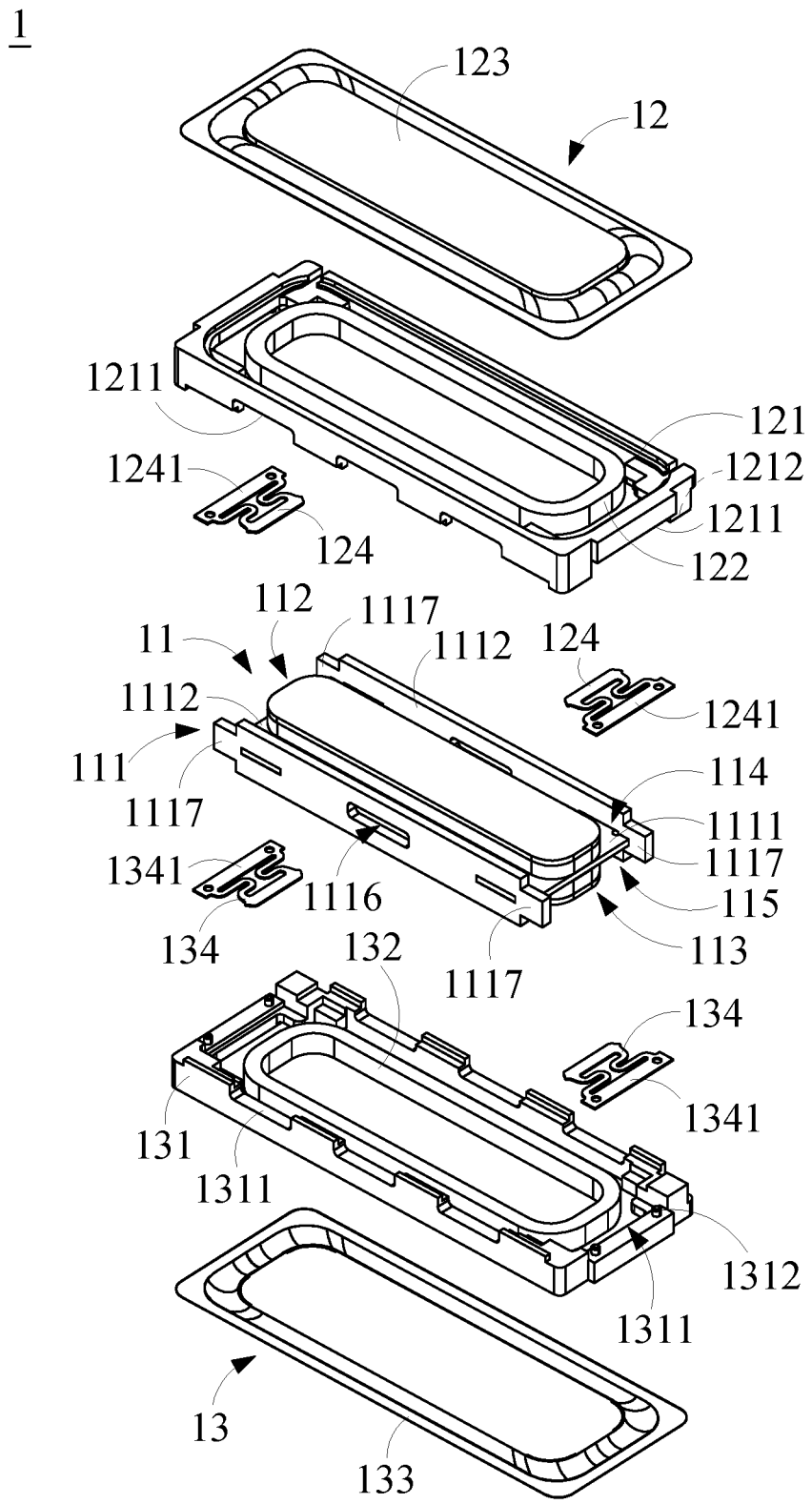
FIG. 3 is another schematic exploded view of the double-sided vibrating speaker of the present disclosure.
Figure 4:
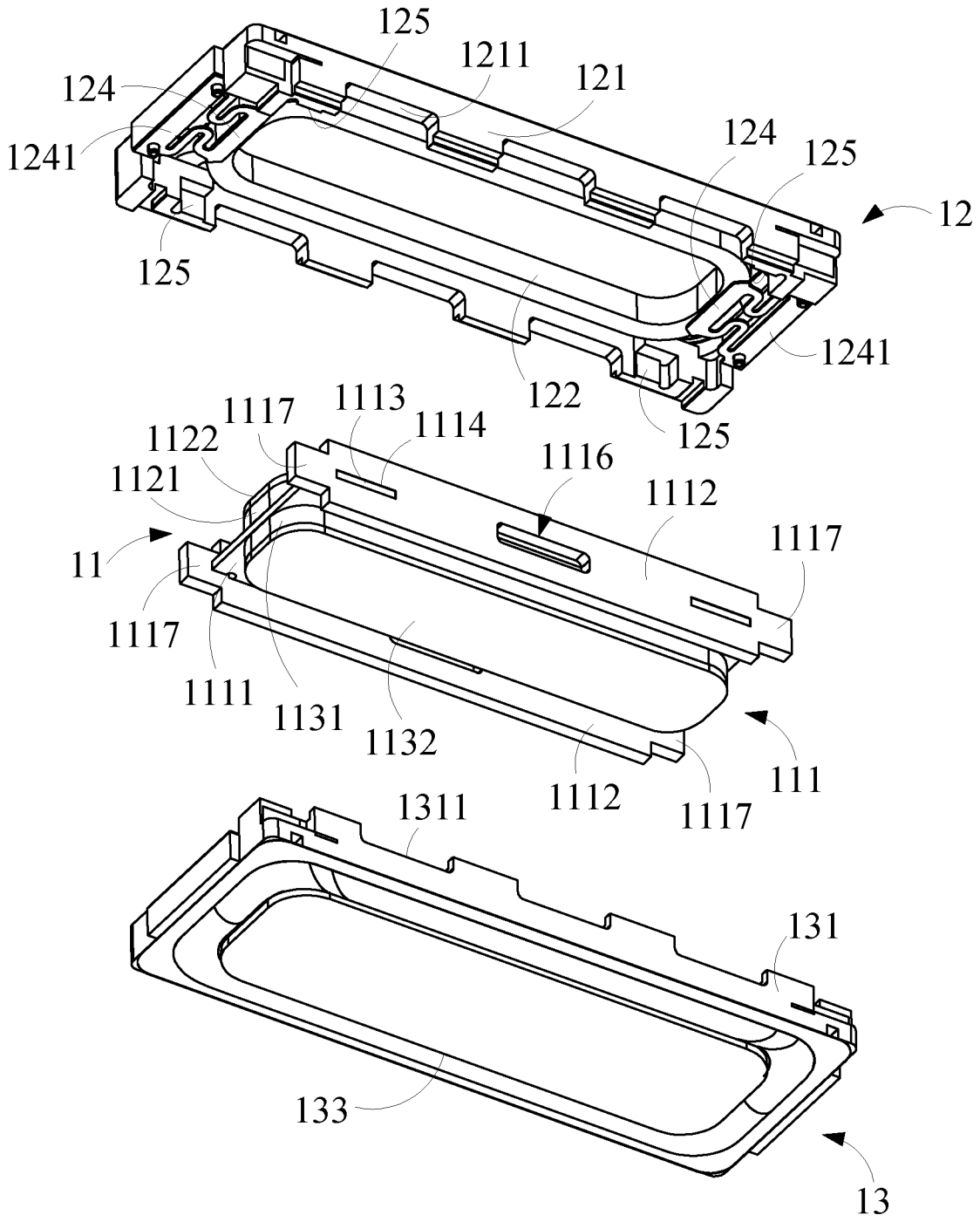
FIG. 4 is a schematic exploded view of the double-sided vibrating speaker from another angle of the present disclosure.
Figure 5:
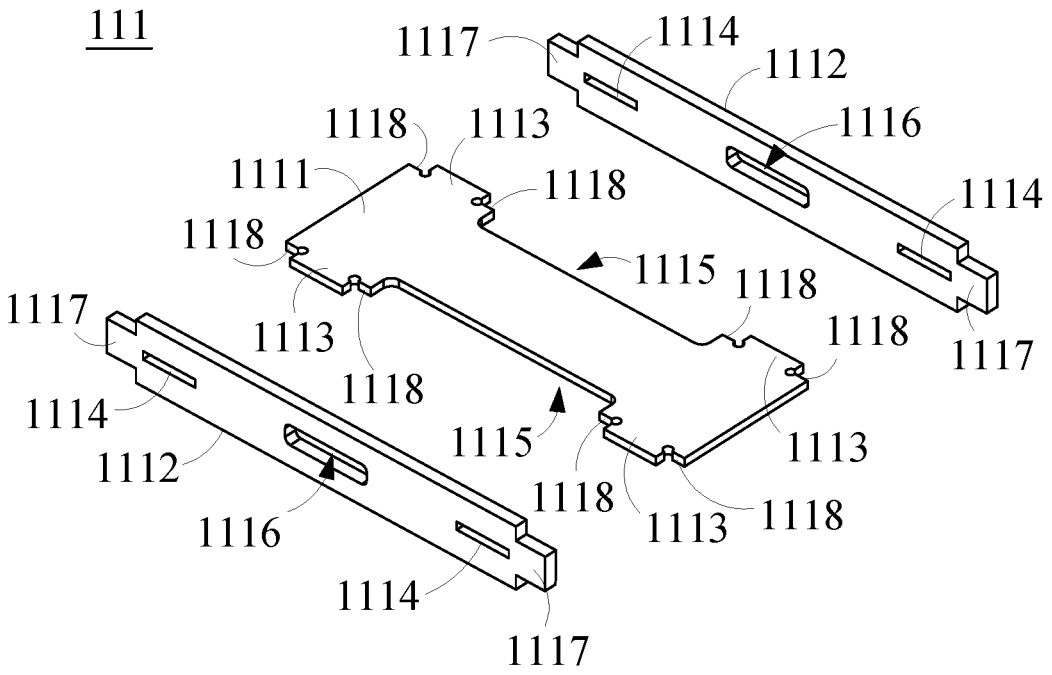
FIG. 5 is a schematic exploded view of a main magnetic unit of the present disclosure.
Figure 6:
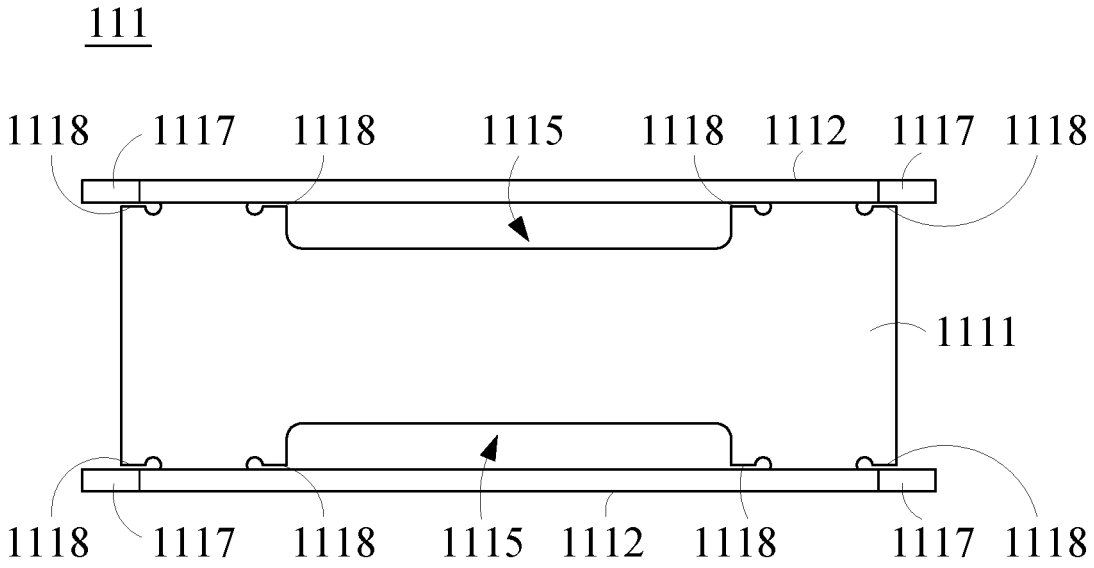
FIG. 6 is a schematic outside top view of a main magnetic unit of the present disclosure.
Figure 7:
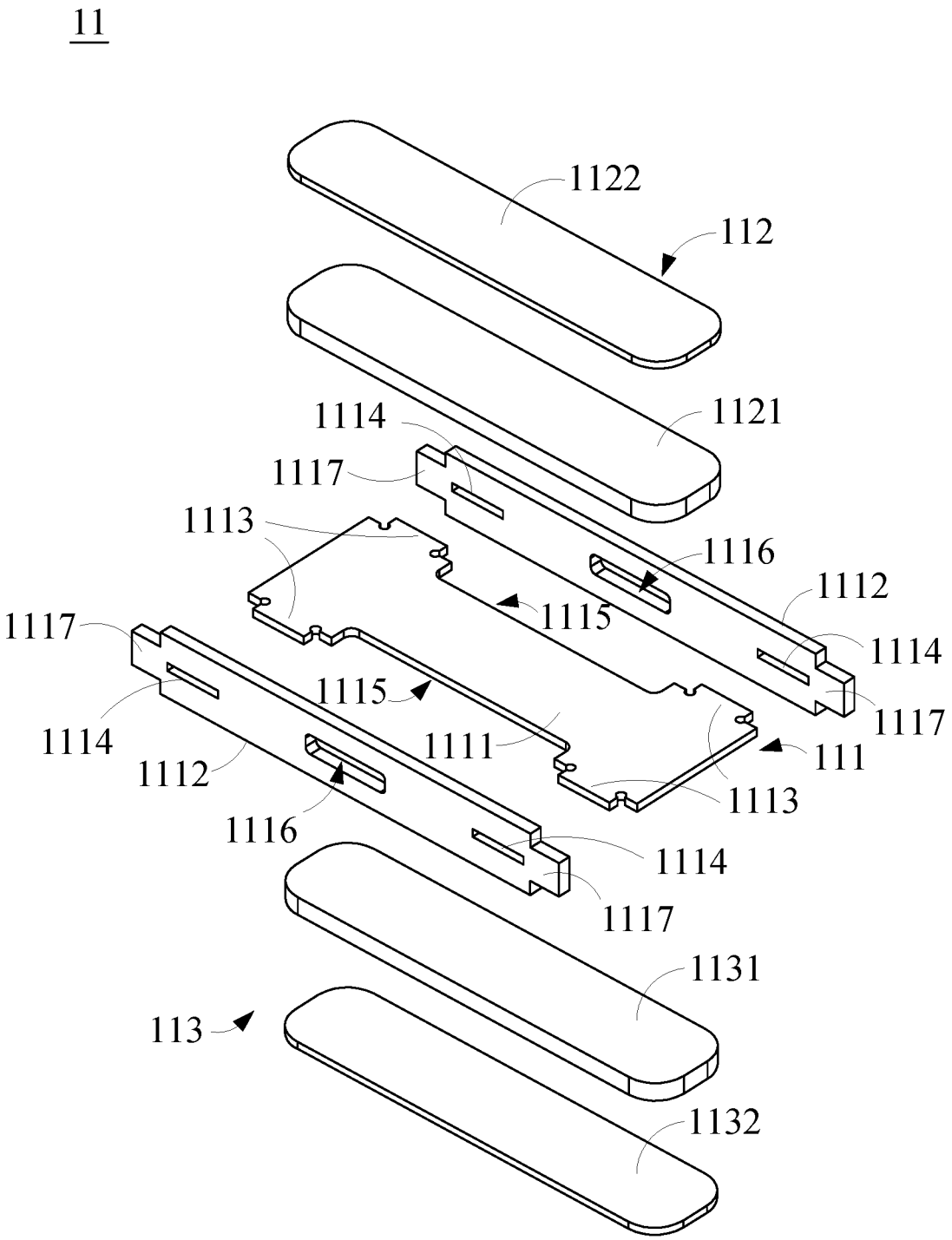
FIG. 7 is a schematic exploded view of a magnet member of the present disclosure.

Referring to FIGS. 1 and 2, as shown in the drawings, the present disclosure provides a double-sided vibrating speaker 1 comprising: a magnet member 11, a first vibration member 12 and a second vibration member 13. The structure of the first vibration member 12 may be the same as the structure of the second vibration assembly 13, and the first vibration member 12 and the second vibration member 13 may be symmetrical with the magnet member 11 as the center.

Referring to FIGS. 3 to 7, as shown in the drawings, the magnet member 11 comprises a main magnetic unit 111, a first magnetic unit 112 and a second magnetic unit 113, the main magnetic unit 111 has a main magnetic plate 1111 and two side magnetic plates 1112, the main magnetic plate 1111 has at least one air vent 1115, each the side magnetic plate 1112 is provided on two sides of the main magnetic plate 1111, the main magnetic plate 1111 respectively has at least one assembly part 1113 at two sides, each the side magnetic plate 1112 has at least one docking part 1114 in combination with the assembly part 1113, the profile of the main magnetic unit 111 forms an H-shape, the first magnetic unit 112 is disposed on one surface of the main magnetic plate 1111, the second magnetic unit 113 is disposed on another surface of the main magnetic plate 1111, the first magnetic unit 111 has a first magnetic gap 114, the second magnetic unit 113 has a second magnetic gap 115.

The first vibration member 12 comprises a first speaker frame 121, a first voice coil 122 and a first diaphragm 123, the first speaker frame 121 is configured with a surface of the magnet member 11, the first voice coil 122 is movably configured in the first magnetic gap 114 and configured with the first diaphragm 123, the first diaphragm 123 is configured with the first speaker frame 121.

The second vibration member 13 comprises a second speaker frame 131, a second voice coil 132 and a second diaphragm 133, the second speaker frame 131 is configured with another surface of the magnet member 11, the second voice coil 132 is movably configured in the second magnetic gap 115 and configured with the second diaphragm 133, the second diaphragm 133 is configured with the second speaker frame 131, the second speaker frame 131 and the first speaker frame 121 are combined with each other.

When the double-sided vibrating speaker 1 of the present disclosure is used, it may be combined with a cabinet (not shown in figures), so that the first vibration member 12 and the second vibration member 13 are provided on two sides of the magnet member 11 in an up-down symmetrical manner, and share the magnet member 11, whereby the first vibration member 12 and the second vibration member 13 respectively go with the first magnetic unit 112 and the second magnetic unit 113 to form two completely independent magnetic fields located in the upper and lower positions (as shown in FIGS. 1, 2 and 8 to 10), and thus the first voice coil 122 and the second voice coil 132 bring the vibration of the first diaphragm 123 and the second diaphragm 133 through the electromagnetic action.

When the first vibration member 12 and the second vibration member 13 actuate, the first voice coil 122 and the second voice coil 132 receive an electronic signal inputted from outside, so that the first diaphragm 123 and the second diaphragm 133 simultaneously actuate outward and simultaneously actuate inward, when the first diaphragm 123 and the second diaphragm 133 simultaneously actuate outward, the air is pushed to vibrate and sound, and when the first diaphragm 123 and the second diaphragm 133 simultaneously actuate inward, the two forces will offset each other through the air vent 1115, so that the first vibration member 12 and the second vibration member 13 implement the function of vibration reduction, in order to avoid the force generated by the first diaphragm 123 and the second diaphragm 133 actuating to drive the entire double-sided vibrating speaker 1 followed by vibration.

Accordingly, in the case of constant size, the double-sided vibrating speaker 1 of the present disclosure may implement a two-way sounding effect, thereby enhancing the output volume and bass of the double-sided vibrating speaker 1 by the design of double-sided diaphragm including the first diaphragm 123 and the second diaphragm 133. More importantly, the first vibration member 12 and the second vibration member 13 may be actuated at the same time, so the force between each other is offset, and the vibration control of the double-sided vibrating speaker 1 is further increased, in order to prevent the first diaphragm 123 and the second diaphragm 133 at vibrating from driving the entire double-sided vibrating speaker 1 to produce unnecessary vibration, so as to avoid resonance to produce noise and distortion. In addition, the double-sided vibrating speaker 1 of the present disclosure may allow the first vibration member 12 and the second vibration member 13 respectively to go with the first magnetic unit 112 and the second magnetic unit 113 to form two completely independent magnetic paths located in the upper and lower positions by the H-shaped design of the main magnetic unit 111, and a main magnetic plate 1111 is shared to form two completely independent magnetic paths located in the upper and lower positions, so the overall height of the double-sided vibrating speaker 1 will not be increased. Further, the main magnetic plate 1111 is combined with each the side magnetic plate 1112 by each the assembly part 1113 and each the docking part 1114, so that each the assembly part 1113 and each the docking parts 1114 can be connected by laser welding, in addition to reducing the difficulty of forming the main magnetic unit 111 in metal stamping, it may also reduce the thickness of the double-sided vibrating speaker 1 of the present disclosure.

Further, in the assembly of the double-sided vibrating speaker 1, it only needs to first assemble the magnet member 11, the first vibration member 12 and the second vibration member 13 respectively, and then three components including the magnet member 11, the first vibration member 12 and the second vibration member 13 are directly combined and fixed, the assembly of the double-sided vibrating speaker 1 can be completed. It means that the double-sided vibrating speaker 1 is disassembled into three modules of semi-finished products, and then they are assembled into a finished product at one time, and thus the quality of assembly is more stable and more efficient.

In addition to the above embodiments, in an embodiment of the present disclosure (as shown in FIGS. 1 to 7), the main magnetic plate 1111 respectively has the air vents 1115 on two sides, each the air vent 1115 is recessed, the first speaker frame 121 and the second speaker frame 131 respectively have at least one open pore 10 on two sides, each the open pore 10 communicates each the air vent 1115.

In addition to the above embodiments, in an embodiment of the present disclosure (as shown in FIGS. 1 to 4 and 10), each the side magnetic plate 1112 has a breathable hole 1116, a hole diameter of each the breathable hole 1116 is greater than a thickness of the main magnetic plate 1111, each the breathable hole 1116 is provided across one surface and another surface of the main magnetic plate 1111, the first speaker frame 121 and the second speaker frame 131 respectively have at least one open pore 10 on two sides, each the open pore 10 communicates each the breathable hole 1116 and the air vent 1115.

In an embodiment of the present disclosure (as shown in FIGS. 1 to 4), the first speaker frame 121 and the second speaker frame 131 respectively have at least one open pore 10 on two sides, each the open pore 10 communicates each the air vent 1115. Accordingly, the double-sided vibrating speaker 1 of the present disclosure may make the air flow and force generated by the first diaphragm 123 and the second diaphragm 133 actuating offset sufficiently by the cooperation of each the air vent 1115 and each the open pore 10, part of the gas is discharged to the outside from the double-sided vibrating speaker 1, in order to adjust the excessive air flow inside the double-sided vibrating speaker 1, and the vibration control of the double-sided vibrating speaker 1 is further increased, in order to prevent the first diaphragm 123 and the second diaphragm 133 at vibrating from driving the entire double-sided vibrating speaker 1 to produce unnecessary vibration, thereby achieving the vibration control of the double-sided vibrating speaker 1 to avoid resonance to produce noise and distortion.

In an embodiment of the present disclosure (as shown in FIGS. 1 to 7), the main magnetic plate 1111 respectively has the air vents 1115 on two sides, each the air vent 1115 is recessed, each the side magnetic plate 1112 has a breathable hole 1116 in communication with each the air vent 1115. The main magnetic unit 111 is a metal magnetic permeability material (e.g., low carbon steel), so it is difficult to directly form an H shape through the conventional metal stamping process. In order to achieve the main magnetic unit 111 with an H-shaped profile, the main magnetic plate 1111 is planar and the main magnetic plate 1111 has four convex parts after the two recessed air vents 1115 are provided, and each the side magnetic plate 1112 may be provided with two through holes to correspond to the convex parts, in order to combine with the main magnetic plate 1111. In addition, the first speaker frame 121 and the second speaker frame 131 respectively have at least one open pore 10 on two sides, each the open pore 10 communicates each the breathable hole 1116. Further, a long side of the double-sided vibrating speaker 1 may be provided with a plurality of open pores 10, or a short side of the double-sided vibrating speaker 1 may be provided with a single open pore 10, or the long side of the double-sided vibrating speaker 1 may be provided with a plurality of open pores 10 and the short side of the double-sided vibrating speaker 1 may be provided with a single open pore 10. Accordingly, the double-sided vibrating speaker 1 of the present disclosure may make the air flow and force generated by the first diaphragm 123 and the second diaphragm 133 actuating offset sufficiently by the cooperation of each the air vent 1115, each the breathable hole 1116 and each the open pore 10, part of the gas is discharged to the outside from the double-sided vibrating speaker 1, in order to adjust the excessive air flow inside the double-sided vibrating speaker 1, and the vibration control of the double-sided vibrating speaker 1 is further increased, in order to prevent the first diaphragm 123 and the second diaphragm 133 at vibrating from driving the entire double-sided vibrating speaker 1 to produce unnecessary vibration, thereby achieving the vibration control of the double-sided vibrating speaker 1 to avoid resonance to produce noise and distortion.

In an embodiment of the present disclosure (as shown in FIGS. 2 to 7), the main magnetic plate 1111 respectively has the assembly part 1113 at two sides of two end parts, each the side magnetic plate 1112 has the two docking parts 1114 in combination with each the assembly part 1113, after the main magnetic plate 1111 passes through the docking part 1114 of each the side magnetic plate 1112 by each the assembly part 1113, the laser welding method is used to complete the connection between each other, in order to ensure that the main magnetic unit 111 and each the side magnetic plate 1112 are not easy to fall off, so that the main magnetic unit 111 has preferably operational stability.

In an embodiment of the present disclosure (as shown in FIGS. 2 to 7 and 9), each the assembly part 1113 respectively has a stop part 1118 at two sides, and each the assembly part 1113 exceeds the stop parts 1118 in position. After each the assembly part 1113 and each the docking part 1114 are combined, each the stop part 1118 can be used to stop each the side magnetic plate 1112, so that each the assembly part 1113 fails to exceed each the docking part 1114, that is, each the assembly part 1113 fails to exceed the outer wall surface of each the side magnetic plate 1112. Accordingly, when the main magnetic plate 1111 and each the side magnetic plate 1112 are carried out the laser welding, there is a space to place a solder ball (not shown in the figures), therefore, even if the solder ball protrudes out of the wall surface of each the side magnetic plate 1112, because there is a space area 20 between each the side magnetic plate 1112 and the first speaker frame 121 and the second speaker frame 131, when the magnet member 11 is assembled to the first speaker frame 121 and the second speaker frame 131, the interference will not be produced. Further, each the assembly part 1113 fails to exceed the outer wall surface of each the side magnetic plate 1112 that may also make the magnetic path of the magnet member 11 follow a predetermined magnetic path to avoid magnetic divergence.

In an embodiment of the present disclosure (as shown in FIGS. 2 to 7), each the docking part 1114 is a penetration hole. Accordingly, the double-sided vibrating speaker 1 of the present disclosure may be completed by laser welding each the assembly part 1113 and each the docking part 1114 from the outer side of each the side magnetic plate 1112.

Figure 8:
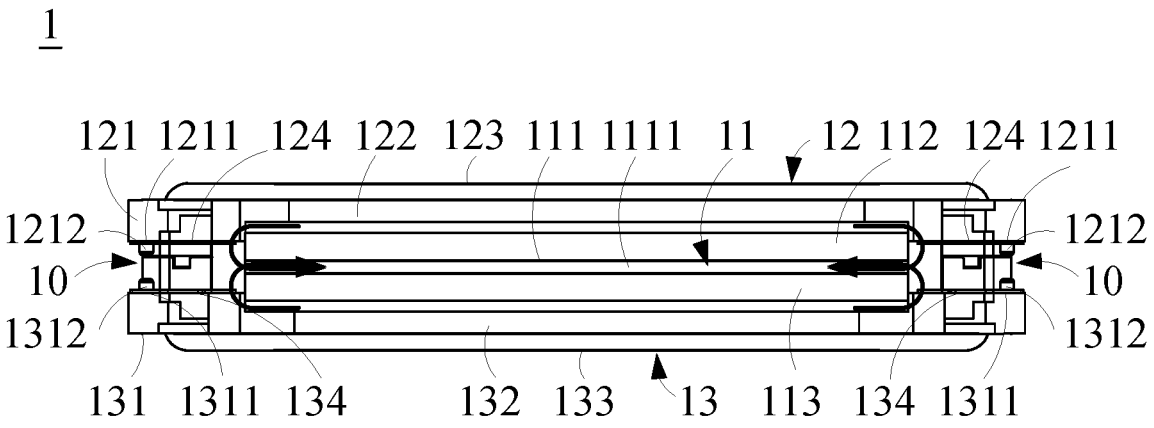
FIG. 8 is a schematic sectional state view along A-A of FIG. 1 of the present disclosure.
Figure 9:
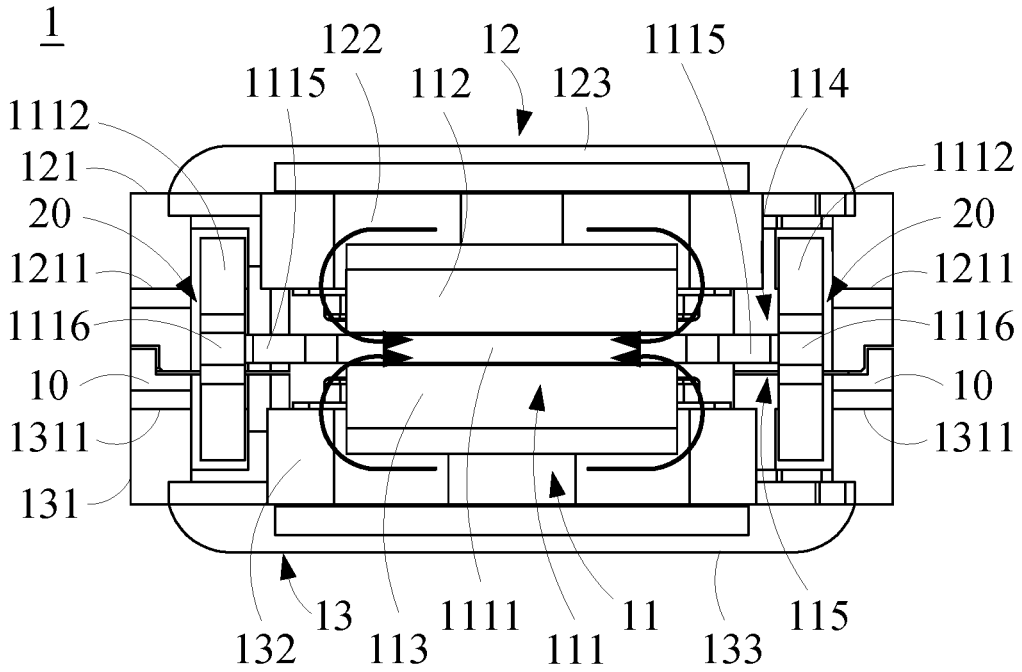
FIG. 9 is a schematic sectional state view along B-B of FIG. 1 of the present disclosure.
Figure 10:
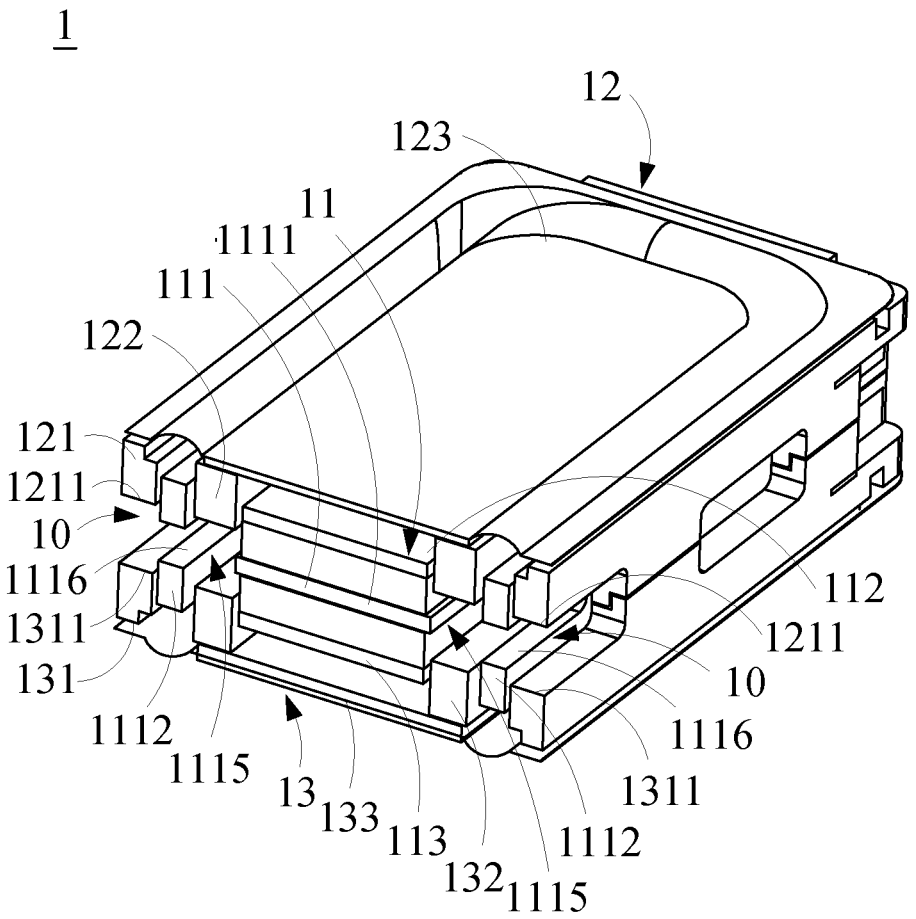
FIG. 10 is another schematic sectional state view along B-B of FIG. 1 of the present disclosure.

In an embodiment of the present disclosure (as shown in FIGS. 2 to 7), the first magnetic unit 112 has a first magnet 1121 and a first magnetic plate 1122, the second magnetic unit 113 has a second magnet 1131 and a second magnetic plate 1132, the first magnet 1121 is disposed on one surface of the main magnetic plate 1111, the first magnetic plate 1122 is disposed on the first magnet 1121, the second magnet 1131 is disposed on another surface of the main magnetic plate 1111, the second magnetic plate 1132 is disposed on the second magnet 1131. Accordingly, the double-sided vibrating speaker 1 may allow the first vibration member 12 and the second vibration member 13 respectively to go with the first magnetic unit 112 and the second magnetic unit 113 to form two completely independent magnetic fields located in the upper and lower positions (as shown in FIGS. 8 and 9), and thus the first voice coil 122 and the second voice coil 132 bring the vibration of the first diaphragm 123 and the second diaphragm 133 through the electromagnetic action.

In an embodiment of the present disclosure (as shown in FIGS. 1 to 4 and 8 to 10), the first speaker frame 121 respectively have at least one first opening part 1211 on two sides, the second speaker frame 131 respectively have at least one second opening part 1311 on two sides, each the first opening part 1211 and each the second opening part 1311 correspond to each other to form the open pore 10; in the present embodiment, the first speaker frame 121 respectively has three first opening parts 1211 on two sides, the second speaker frame 131 respectively has three second opening parts 1311 on two sides, so that the two sides of the double-sided vibrating speaker 1 respectively has three openings 10, and one of the openings 10 on two sides respectively corresponds to each the breathable hole 1116. Accordingly, the double-sided vibrating speaker 1 of the present disclosure may make the air flow and force generated by the first diaphragm 123 and the second diaphragm 133 actuating offset sufficiently by the cooperation of each the open pore 10, each the air vent 1115 and each the breathable hole 1116, part of the gas is discharged to the outside from the double-sided vibrating speaker 1, in order to adjust the excessive air flow inside the double-sided vibrating speaker 1, and the vibration control of the double-sided vibrating speaker 1 is further increased, in order to prevent the first diaphragm 123 and the second diaphragm 133 at vibrating from driving the entire double-sided vibrating speaker 1 to produce unnecessary vibration, thereby achieving the vibration control of the double-sided vibrating speaker 1 to avoid resonance to produce noise and distortion.

In an embodiment of the present disclosure (as shown in FIGS. 2 to 7), each the side magnetic plate 1112 respectively has a connecting part 1117 at two ends, the first speaker frame 121 and the second speaker frame 131 are correspondingly assembled to the connecting parts 1117, so that the second speaker frame 131 and the first speaker frame 121 are combined with each other, and a space area 20 is formed between the outer side of each the side magnetic plate 1112 and the first speaker frame 121 and the second speaker frame 131, the space area 20 is communicated to each the open pore 10 and each the breathable hole 1116. Accordingly, the double-sided vibrating speaker 1 of the present disclosure may make the air flow and force generated by the first diaphragm 123 and the second diaphragm 133 actuating offset sufficiently by the cooperation of each the open pore 10, each the air vent 1115 and each the breathable hole 1116, part of the gas is discharged to the outside from the double-sided vibrating speaker 1, so that the excessive air flow will not be accumulated in the space area 20, in order to adjust the excessive air flow inside the double-sided vibrating speaker 1, and the vibration control of the double-sided vibrating speaker 1 is further increased, in order to prevent the first diaphragm 123 and the second diaphragm 133 at vibrating from driving the entire double-sided vibrating speaker 1 to produce unnecessary vibration, thereby achieving the vibration control of the double-sided vibrating speaker 1 to avoid resonance to produce noise and distortion.

In one embodiment of the present disclosure (as shown in FIGS. 2 to 4 and 9), corresponding assembly places of the first speaker frame 121 and the connecting parts 1117 are respectively provided with a protruding part 125, the connecting part 1117 of each the side magnetic plate 1112 and each the protruding part 125 are abutted against each other, so that the space area 20 is formed between the outer side of each the side magnetic plate 1112 and the first speaker frame 121 and the second speaker frame 131; accordingly, by cooperating with each the connecting part 1117 and each the protruding part 125, it is avoided to interfere with the assembly that is caused by the protrusion of the solder balls during laser welding.

In an embodiment of the present disclosure (as shown in FIGS. 1 to 4, 8 and 9), the first vibration member 12 further comprises two first dampers 124, each the first damper 124 has a first fixed part 1241 (e.g., positioning hole) at one side, each the first damper 124 combines with the first voice coil 122 at another side, the first speaker frame 121 respectively has a first combination part 1212 (e.g., positioning convex body) at two sides, the first fixed part 1241 of each the first damper 124 is combined to each the first combination part 1212 of the first speaker frame 121, and the second vibration member 13 further comprises two second dampers 134, each the second damper 134 has a second fixed part 1341 (e.g., positioning hole) at one side, each the second damper 134 combines with the second voice coil 132 at another side, the second speaker frame 131 respectively has a second combination part 1312 (e.g., positioning convex body) at two sides, the second fixed part 1341 of each the second damper 134 is combined to each the second combination part 1312 of the second speaker frame 131. Accordingly, the double-sided vibrating speaker 1 of the present disclosure may respectively stably maintain the positions of the first voice coil 122 and the second voice coil 132 by the first dampers 124 and the second dampers 134, in addition to increasing the handle power of the double-sided vibrating speaker 1 to output a greater volume, the double-sided vibrating speaker 1 at low frequencies can avoid that the first voice coil 122 and the second voice coil 132 produce vibration to deviate from the axis, resulting in heterophonic distortion problems.

In an embodiment of the present disclosure (as shown in FIGS. 1 to 4 and 8), a long side of the double-sided vibrating speaker 1 may be provided with a plurality of open pores 10, a short side of the double-sided vibrating speaker 1 may be provided with a single open pore 10, each the first combination part 1212 may be located at the first opening part 1211 of each the open pore 10 on the short side of the double-sided vibrating speaker 1, each the second combination part 1312 may be located at the second opening part 1311 of each the open pore 10 on the short side of the double-sided vibrating speaker 1, in order to simplify the structure of the double-sided vibrating speaker 1 of the present disclosure. In addition, each the first combination part 1212 may also be located at the first opening part 1211 of the open pores 10 on the long side of the double-sided vibrating speaker 1, each the second combination part 1312 may also be located at the second opening part 1311 of the open pores 10 on the long side of the double-sided vibrating speaker 1.

While the present disclosure has been described by means of specific embodiments, numerous modifications and variations could be made thereto by those skilled in the art without departing from the scope and spirit of the present disclosure set forth in the claims. Therefore, the protection scope of the disclosure shall be defined by the claims.

What is claimed is:

1. A double-sided vibrating speaker, comprising:

a magnet member, comprising a main magnetic unit, a first magnetic unit and a second magnetic unit, the main magnetic unit has a main magnetic plate and two side magnetic plates, the main magnetic plate has at least one air vent, each side magnetic plate is provided on a corresponding side of the main magnetic plate, the main magnetic plate has at least one assembly part at the corresponding side, each side magnetic plate has at least one docking part in combination with the assembly part, the main magnetic unit forms an H-shape, the first magnetic unit is disposed on one surface of the main magnetic plate, the second magnetic unit is disposed on another surface of the main magnetic plate, the first magnetic unit has a first magnetic gap, the second magnetic unit has a second magnetic gap;

a first vibration member, comprising a first speaker frame, a first voice coil and a first diaphragm, the first speaker frame is provided with a surface of the magnet member, the first voice coil is movably disposed in the first magnetic gap and provided with the first diaphragm, the first diaphragm is provided with the first speaker frame; and a second vibration member, comprising a second speaker frame, a second voice coil and a second diaphragm, the second speaker frame is provided with another surface of the magnet member, the second voice coil is movably disposed in the second magnetic gap and provided with the second diaphragm, the second diaphragm is provided with the second speaker frame, the second speaker frame and the first speaker frame are combined with each other.

2. The double-sided vibrating speaker according to claim 1, wherein the main magnetic plate respectively has the assembly part at two sides of two end parts, each side magnetic plate has two docking parts in combination with each assembly part.

3. The double-sided vibrating speaker according to claim 2, wherein each assembly part respectively has a stop part at two sides, and each assembly part exceeds the stop parts in position, each stop part stops each side magnetic plate, each assembly part fails to exceed each docking part in position.

4. The double-sided vibrating speaker according to claim 1, wherein the docking part is a penetration hole.

5. The double-sided vibrating speaker according to claim 1, wherein the first speaker frame and the second speaker frame respectively have at least one open pore on two sides, each open pore communicates the air vent.

6. The double-sided vibrating speaker according to claim 1, wherein the main magnetic plate respectively has the air vents on two sides, each air vent is recessed, each side magnetic plate has a breathable hole in communication with each air vent, the first speaker frame and the second speaker frame respectively have at least one open pore on two sides, each open pore communicates each breathable hole.

7. The double-sided vibrating speaker according to claim 6, wherein the first speaker frame has at least one first opening part on two sides, the second speaker frame has at least one second opening part on two sides, each first opening part and each second opening part correspond to each other to form the open pore.

8. The double-sided vibrating speaker according to claim 6, wherein the first vibration member further comprises two first dampers, each first damper has a first fixed part at one side, each first damper combines with the first voice coil at another side, the first speaker frame respectively has a first combination part at two sides, the first fixed part of each first damper is combined to each first combination part of the first speaker frame, each first combination part is located at the open pore; the second vibration member further comprises two second dampers, each second damper has a second fixed part at one side, each second damper combines with the second voice coil at another side, the second speaker frame respectively has a second combination part at two sides, the second fixed part of each second damper is combined to each second combination part of the second speaker frame, each second combination part is located at the open pore.

9. The double-sided vibrating speaker according to claim 1, wherein each side magnetic plate has a breathable hole, a hole diameter of each breathable hole is greater than a thickness of the main magnetic plate, each breathable hole is provided across one surface and another surface of the main magnetic plate, the first speaker frame and the second speaker frame respectively have at least one open pore on two sides, each open pore communicates each breathable hole and the air vent.

10. The double-sided vibrating speaker according to claim 1, wherein the main magnetic plate respectively has the air vents on two sides, each air vent is recessed, the first speaker frame and the second speaker frame respectively have at least one open pore on two sides, each open pore communicates each air vent.

11. The double-sided vibrating speaker according to claim 1, wherein each side magnetic plate respectively has a connecting part at two ends, the first speaker frame and the second speaker frame are correspondingly assembled to the connecting parts, a space area is formed between the outer side of each side magnetic plate and the first speaker frame and the second speaker frame.

12. The double-sided vibrating speaker according to claim 11, wherein corresponding assembly places of the first speaker frame and the connecting parts are respectively provided with a protruding part, the connecting part of each side magnetic plate and each protruding part are abutted against each other, so that the space area is formed between the outer side of each side magnetic plate and the first speaker frame and the second speaker frame.

13. The double-sided vibrating speaker according to claim 1, wherein the first magnetic unit has a first magnet and a first magnetic plate, the second magnetic unit has a second magnet and a second magnetic plate, the first magnet is disposed on one surface of the main magnetic plate, the first magnetic plate is disposed on the first magnet, the second magnet is disposed on another surface of the main magnetic plate, the second magnetic plate is disposed on the second magnet.

14. The double-sided vibrating speaker according to claim 1, wherein the first vibration member further comprises two first dampers, each first damper has a first fixed part at one side, each first damper combines with the first voice coil at another side, the first speaker frame respectively has a first combination part at two sides, the first fixed part of each first damper is combined to each first combination part of the first speaker frame; the second vibration member further comprises two second dampers, each second damper has a second fixed part at one side, each second damper combines with the second voice coil at another side, the second speaker frame respectively has a second combination part at two sides, the second fixed part of each second damper is combined to each second combination part of the second speaker frame.

* * * * *